US011655690B2

(12) United States Patent
Al-Rubaii et al.

(10) Patent No.: US 11,655,690 B2
(45) Date of Patent: May 23, 2023

(54) BOREHOLE CLEANING MONITORING AND ADVISORY SYSTEM

(71) Applicant: Saudi Arabian Oil Company, Dhahran (SA)

(72) Inventors: Mohammed Murif Al-Rubaii, Dammam (SA); Eno Itam Omini, Dhahran (SA); Bader M. Alotaibi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/408,123

(22) Filed: Aug. 20, 2021

(65) Prior Publication Data

US 2023/0057364 A1 Feb. 23, 2023

(51) Int. Cl.
*E21B 37/00* (2006.01)
*E21B 47/007* (2012.01)
*E21B 45/00* (2006.01)

(52) U.S. Cl.
CPC ..... *E21B 37/00* (2013.01); *E21B 45/00* (2013.01); *E21B 47/007* (2020.05); *E21B 2200/20* (2020.05)

(58) Field of Classification Search
CPC ..... E21B 37/00; E21B 45/00; E21B 47/007; E21B 2200/20
See application file for complete search history.

(56) References Cited

U.S. PATENT DOCUMENTS

| | | | | |
|---|---|---|---|---|
| 4,844,182 | A * | 7/1989 | Tolle | E21B 21/08 175/48 |
| 10,436,010 | B2 | 10/2019 | Wesley et al. | |
| 10,590,761 | B1 | 3/2020 | Martinez et al. | |
| 10,781,681 | B2 * | 9/2020 | Santos | E21B 44/00 |
| 10,989,046 | B2 | 4/2021 | Al-Rubaii et al. | |
| 2004/0060738 | A1 | 4/2004 | Hemphill | |
| 2005/0126777 | A1 | 6/2005 | Rolovic et al. | |

(Continued)

FOREIGN PATENT DOCUMENTS

| | | |
|---|---|---|
| CA | 2852765 | 5/2013 |
| CA | 3023860 | 12/2017 |

(Continued)

OTHER PUBLICATIONS

Abdelgawad et al., "New approach to evaluate the equivalent circulating density (ECD) using artifical intelligence techniques," Journal of Petroleum Exploration and Production Technology, Oct. 23, 2018, 10 pages.

(Continued)

*Primary Examiner* — Jonathan Malikasim
(74) *Attorney, Agent, or Firm* — Fish & Richardson P.C.

(57) ABSTRACT

Disclosed are methods, systems, and computer-readable medium to perform operations including: receiving real-time drilling data of a drilling operation of drilling a wellbore; using the drilling data to calculate at least one indicator of a borehole cleaning efficiency of the drilling operation; detecting, based on the least one indicator of the borehole cleaning efficiency, a drilling problem with the drilling operation; determining a corrective action to avoid or mitigate the drilling problem; and performing the corrective action to avoid or mitigate the drilling problem.

15 Claims, 6 Drawing Sheets

300

| CCA | CCI | TR | Recommendations |
|---|---|---|---|
| Green | Green | Green | Optimized |
| Yellow | Green | Green | Increase ROP |
| Yellow | Yellow | Green | Increase ROP |
| Yellow | Green | Yellow | Increase ROP |
| Yellow | Yellow | Yellow | Increase ROP |
| Yellow | Yellow | Red | Optimize rheological properties, increase GPM, Increase ROP |
| Yellow | Red | Yellow | Optimize rheological properties, increase GPM, Increase ROP |
| Red | Yellow | Yellow | Reduce ROP, Optimize rheological properties, increase GPM |
| Red | Green | Green | Reduce ROP |
| Red | Red | Red | Reduce ROP, Optimize rheological properties, increase GPM |
| Green | Yellow | Green | Optimize rheological properties, increase GPM |
| Green | Red | Green | Reduce ROP, Optimize rheological properties |
| Green | Yellow | Yellow | Optimize rheological properties, increase GPM |
| Green | Red | Yellow | Reduce ROP, Optimize rheological properties, increase GPM |
| Red | Red | Green | Reduce ROP, Optimize rheological properties, increase GPM |
| Red | Yellow | Red | Reduce ROP, Optimize rheological properties, increase GPM |
| Yellow | Red | Red | Reduce ROP, Optimize rheological properties, increase GPM |
| Green | Red | Red | Reduce ROP, Optimize rheological properties, increase GPM |

(56) References Cited

U.S. PATENT DOCUMENTS

| | | | |
|---|---|---|---|
| 2011/0153296 | A1 | 6/2011 | Sadlier et al. |
| 2013/0054146 | A1 | 2/2013 | Rasmus |
| 2013/0085675 | A1 | 4/2013 | Prakash et al. |
| 2014/0131104 | A1 | 5/2014 | Coley et al. |
| 2014/0291023 | A1 | 10/2014 | Edbury et al. |
| 2014/0343694 | A1 | 11/2014 | Aldred et al. |
| 2015/0129306 | A1 | 5/2015 | Coffman et al. |
| 2015/0176402 | A1 | 6/2015 | Prakash et al. |
| 2015/0226049 | A1 | 8/2015 | Frangos et al. |
| 2015/0300151 | A1 | 10/2015 | Mohaghegh |
| 2016/0053604 | A1 | 2/2016 | Abbassian |
| 2016/0245048 | A1 | 8/2016 | Jamison et al. |
| 2016/0369627 | A1 | 12/2016 | Kulkarni et al. |
| 2017/0044896 | A1 | 2/2017 | Salminen |
| 2017/0306724 | A1 | 10/2017 | Forstner et al. |
| 2018/0012384 | A1 | 1/2018 | Marland et al. |
| 2018/0119537 | A1 | 5/2018 | Viens et al. |
| 2019/0055797 | A1 | 2/2019 | Astrid et al. |
| 2019/0316457 | A1* | 10/2019 | Al-Rubaii ..... E21B 21/08 |
| 2019/0323328 | A1 | 10/2019 | Rao et al. |
| 2019/0376385 | A1 | 12/2019 | Martinez et al. |
| 2020/0362694 | A1 | 11/2020 | Al-Rubaii et al. |
| 2020/0370381 | A1 | 11/2020 | Al-Rubaii et al. |
| 2020/0371495 | A1 | 11/2020 | Al-Rubaii et al. |
| 2021/0140300 | A1 | 5/2021 | Al-Rubaii et al. |

FOREIGN PATENT DOCUMENTS

| | | |
|---|---|---|
| CN | 105626041 | 6/2016 |
| WO | WO 2011130159 | 10/2011 |
| WO | WO 2016034945 | 3/2016 |
| WO | WO 2017027105 | 2/2017 |
| WO | WO 2017209730 | 7/2017 |

OTHER PUBLICATIONS

Agarwal and McNeill, "Real-Time Cleaning of Time-Series Data for a Floating System Digital Twin," OTC-29642-MS, presented at the Offshore Technology Conference held in Houston, Texas, USA, May 6-9, 2019, 13 pages.

Ahmed et al., "The effect of drillstring rotation on equivalent circulation density: modeling and analysis of field measurements," SPE 135587, SPE Annual Technical Conference and Exhibition, Society of Petroleum Engineers, Sep. 19-22, 2010, 11 pages.

Aldred et al., "Managing Drilling Risk," Oilfield Review, Summer 1999, 18 pages.

Anonymous, drillingformulas.com [online], "Increase in mud weight due to cutting—drilling formulas and drilling calculations," available on or before Mar. 7, 2014, Jul. 28, 2020, retrieved from URL <http://www.drillingforumulas.com/increase-in-mud-weight-and-ecd-due-to-cutting/>, 8 pages.

Anonymous, drillingformulas.com [online], "Maximum ROP before fracture formation—drilling formulas and drilling calculations," available on or before Mar. 11, 2014, retrieved on Jul. 28, 2020, retrieved from URL <http://www.drillingforumulas.com/maximum-rop-before-fracture-formation/>, 7 pages.

Baldino et al., "Cuttings settling and slip velocity evaluation in synthetic drilling fluids," 12th Offshore Mediterranean Conference and Exhibition, Offshore Mediterranean Conference, Ravenna, Italy, Mar. 25-27, 2015, 15 pages.

Baranthol et al., "Determination of hydrostatic pressure and dynamic ECD by computer models and field measurements on the directional HPHT well 22130C-13," SPE/IADC 29430, SPE/IADC Drilling Conference, Society of Petroleum Engineers, Feb. 28-Mar. 2, 1995, 10 pages.

Elzenary et al., "New technology to evaluate equivalent circulating density while drilling using artificial intelligence," SPE 192282-MS, SPE Kingdom of Saudi Arabia Annual Technical Symposium and Exhibition, Society of Petroleum Engineers, Apr. 23-26, 2018, 14 pages.

Feng, "The Temperature of Prediction in Deepwater Drilling of Vertical Well," dissertation submitted to the Office of Graduate Studies of Texas A&M University in partial fulfillment of the requirements of the degree of Doctor of Philosophy, May 2011, 146 pages.

Guria, "Rheological analysis of drilling fluid using Marsh Funnel," Department of Petroleum Engineering, Indian School of Mines, 2013, 8 pages.

Harris et al., "Evaluation of equivalent circulating density of drilling fluids under high pressure/high temperature conditions," SPE 97018, SPE Annual Technical Conference and Exhibition, Society of Petroleum Engineers, Oct. 9-12, 2005, 10 pages.

Hopkin, "Factors Affecting Cuttings Removal during Rotary Drilling," Journal of Petroleum Technology, 19(6), Jun. 1967, 8 pages.

Luo et al., "Simple Charts to Determine Hole Cleaning Requirements in Deviated Wells," IADC/SPE 27486, SPE/IADC Drilling Conference, Society of Petroleum Engineers, Feb. 15-18, 1994, 7 pages.

Marsh, "Properties and Treatment of Rotary Mud," Society of Petroleum Engineers, Transactions of the AIME vol. 92, No. 1, Dec. 1931, 16 pages.

Maurer, "The Perfect Cleaning Theory of Rotary Drilling," Journal of Petroleum Technology 14.11, Nov. 1962, 5 pages.

Nazari et al., "Review of Cuttings transport in directional well drilling: systematic approach," SPE 132372, SPE Western Regional Meeting, Society of Petroleum Engineers, Anaheim California, May 27-29, 2010, 15 pages.

Osman and Aggour, "Determination of drilling mud density change with pressure and temperature made simple and accurate by ANN," SPE 81422, SPE, Society of Petroleum Engineers, Bahrain, Jun. 9-12, 2003, 12 pages.

Paiaman et al., "Effect of Drilling Fluid Properties on Rate Penetration," Nafta vol. 60, No. 3, 2009, 6 pages.

Petrowiki, "Hole Cleaning," retrieved on Jan. 25, 2019, 8 pages.

Ranjbar, "Cutting Transport in Inclined and Horizontal Wellbore," University of Stavanger, Faculty of Science and Technology, Master's Thesis, Jul. 6, 2010, 137 pages.

Rasi, "Hold Cleaning in Large, High-Angle Wellbores," SPE/IADC Drilling Conference, Society of Petroleum Engineers, Feb. 15-18, 1994, 12 pages.

Robinson and Morgan, "Effect of Hole Cleaning on Drilling Rate Performance," Paper Aade-04-Df-Ho-42, AADE 2004 Drilling Fluids Conference, Houston, Texas, Apr. 6-7, 2004, 7 pages.

Robinson, "Economic Consequences of Poor Solids and Control," AADE 2006 Fluids Conference and Houston, Texas, Apr. 11-12, 2006, 9 pages.

Rubaii et al., "A New Robust Approach for Hole Cleaning to Improve Rate of Penetration," SPE Kingdom of Saudi Arabia Annual Technical Symposium and Exhibition. Society of Petroleum Engineers, Aug. 2018, 40 pages.

Saasen et al., "Automatic measurement of drilling fluid and drill-cutting properties," SPE 112687, SPE drilling and completion 24,04, Orlando, Florida, Mar. 4-6, 2008, Dec. 2009, 15 pages.

Saini et al., "Predictive Action Planning for Hole Cleaning Optimization and Stuck PipePrevention Using Digital Twinning and Reinforcement Learning," IADC/SPE-199548-MS, Society of Petroleum Engineers, presented at the IADC/SPE International Drilling Conference and Exhibition held in Galveston, Texas, Mar. 3-5, 2020, 18 pages.

Sifferman et al., "Drilling cutting transport in full scale vertical annuli," Journal of Petroleum Technology 26.11, 48th Annual Fall Meeting of the Society of Petroleum Engineers of AIME, Las Vegas, Sep. 30-Oct. 3, 1973, 12 pages.

Unegbu Celestine Tobenna, "Hole Cleaning Hydraulics," Universitetet o Stavanger, Faculty of Science and Technology, Master's Thesis, Jun. 15, 2010, 75 pages.

Wastu et al., "The effect of drilling mud on hole cleaning in oil and gas industry," Journal of Physics: Conference Series, Dec. 2019, 1402(2), 7 pages.

Williams and Bruce, "Carrying Capacity of Drilling Muds," Journal of Petroleum Technology, 3.04, vol. 192, Apr. 1951, 10 pages.

(56) References Cited

OTHER PUBLICATIONS

Xia et al., "A Cutting Concentration Model of a Vertical Wellbore Annulus in Deep-water Drilling Operation and its Application," Applied Mechanics and Materials, vol. 101-102, Sep. 27, 2011, 5 pages.
Zhou et al., "Mechanical specific energy versus depth of cut," 46th US Rock Mechanics/Geomechanics Symposium, American Rock Mechanics Association, ARMA 12-622, Chicago, Illinois, Jun. 24-27, 2012, 6 pages.

* cited by examiner

200

| Indicator | Optimized | OK | Caution |
|---|---|---|---|
| Transport Ratio | > 0.65 | > 0.5 | <= 0.5 |
| Cuttings concentration in annulus | 0.03< CCA <=0.05 | 0<= CCA <=0.03 | CCA > 0.05 |
| Carrying Capacity Index | 3 < CCI | 1 < CCI <= 3 | CCI <= 1 |
| Transport Index | TI > 2.5 | 1.5 <= TI < 2.5 | TI < 1.5 |

FIG. 2

300

| CCA | CCI | TR | Recommendations |
|---|---|---|---|
| Green | Green | Green | Optimized |
| Yellow | Green | Green | Increase ROP |
| Yellow | Yellow | Green | Increase ROP |
| Yellow | Green | Yellow | Increase ROP |
| Yellow | Yellow | Yellow | Increase ROP |
| Yellow | Yellow | Red | Optimize rheological properties, increase GPM, Increase ROP |
| Yellow | Red | Yellow | Optimize rheological properties, increase GPM, Increase ROP |
| Red | Yellow | Yellow | Reduce ROP, Optimize rheological properties, increase GPM |
| Red | Green | Green | Reduce ROP |
| Red | Red | Red | Reduce ROP, Optimize rheological properties, increase GPM |
| Green | Yellow | Green | Optimize rheological properties, increase GPM |
| Green | Red | Green | Reduce ROP, Optimize rheological properties |
| Green | Yellow | Yellow | Optimize rheological properties, increase GPM |
| Green | Red | Yellow | Reduce ROP, Optimize rheological properties, increase GPM |
| Red | Red | Green | Reduce ROP, Optimize rheological properties, increase GPM |
| Red | Yellow | Red | Reduce ROP, Optimize rheological properties, increase GPM |
| Yellow | Red | Red | Reduce ROP, Optimize rheological properties, increase GPM |
| Green | Red | Red | Reduce ROP, Optimize rheological properties, increase GPM |

FIG. 3

BOREHOLE CLEANING MONITORING AND ADVISORY SYSTEM

TECHNICAL FIELD

This disclosure relates to wellbore drilling operations.

BACKGROUND

In wellbore drilling operations, a drilling system causes a drill bit to rotate when in contact with a formation. The rotation of the drill bit breaks and fractures the formation to form the wellbore. The portions of the formation that are broken off during drilling are referred to as "formation cuttings." In order to remove the cuttings from the wellbore, the drilling system circulates a drilling fluid (also referred to as "drilling mud" or "mud") to the drill bit. The drilling fluid exits through drill bit nozzles to the bottom of the wellbore. The drilling fluid carries the formation cuttings from the wellbore to the surface. The ability of the drilling fluid to carry the formation cuttings out of the wellbore is referred to as a carrying capacity of the drilling fluid.

SUMMARY

In existing practice, methods or software for evaluating hole cleaning in real-time does not exist. In particular, there are no real time values or profiles for hole cleaning indicators in existing practice. Additionally, in existing practice, determining equivalent circulating density is only possible using a specialized pressure while drilling (PWD) tool. Further, currently drilling fluid density can only be calculated commercialized devices.

This disclosure describes methods and systems for improving a borehole cleaning efficiency of a borehole drilling operation. In one embodiment, a hole cleaning advisory system (HCAS) calculates indicators that are used to evaluate the borehole cleaning efficiency. To do so, the HCAS receives well data that includes surface rig sensor data and mud rheological properties. The HCAS uses a borehole model and the well data to calculate the borehole cleaning efficiency indicators. The indicators are then used by the HCAS to monitor and evaluate the borehole cleaning efficiency. Monitoring the borehole cleaning efficiency allows the HCAS to help a drilling system (that is performing the drilling operation) to avoid drilling problems. In particular, the HCAS can use the borehole cleaning efficiency to generate recommendations (for example, corrective actions) for improving the drilling operation. In some examples, the HCAS can perform corrective actions based on the recommendations. For instance, the HCAS can control a drilling tool to adjust a drilling parameter that mitigates a detected problem.

Innovative aspects of the subject matter described in this disclosure may be embodied in methods that include the actions of: receiving real-time drilling data of a drilling operation of drilling a wellbore; using the drilling data to calculate at least one indicator of a borehole cleaning efficiency of the drilling operation; detecting, based on the least one indicator of the borehole cleaning efficiency, a drilling problem with the drilling operation; determining a corrective action to avoid or mitigate the drilling problem; and performing the corrective action to avoid or mitigate the drilling problem.

Other embodiments of these aspects include corresponding systems, apparatus, and computer programs, configured to perform the actions of the methods, encoded on computer storage devices. These and other embodiments may each optionally include one or more of the following features.

In some implementations, performing the corrective action involves: controlling the drilling system to adjust one or more drilling parameters that avoid or mitigate the drilling problem.

In some implementations, the drilling parameters comprise: a rate of penetration (ROP) of a drilling tool of the drilling system, a hole size of the wellbore, and a flow rate (GPM) of the drilling fluid.

In some implementations, controlling, based on the effective mud weight, a component of the drilling system to adjust at least one of the drilling parameters involves: determining, based on the real-time drilling data, a rate of penetration for a drilling tool of the drilling system; and controlling the drilling tool such that the rate of penetration of the drilling tool is less than or equal to the determined rate of penetration.

In some implementations, determining the rate of penetration for the drilling tool is further based on a pore pressure limit and a fracture pressure limit.

In some implementations, performing the corrective action involves displaying, via a graphical user interface (GUI), drilling instructions to perform one or more actions to avoid or mitigate the drilling problem.

In some implementations, the least one indicator of the borehole cleaning efficiency comprises at least one of: (1) a modified carrying capacity index (CCI), (2) a modified cuttings concentration in annulus (CCA), (3) a transport ratio (TR) efficiency (TRE), (4) an effective drilling fluid density (MWeff), (5) an equivalent circulating density (ECD), or (6) transport index (TI).

Particular implementations of the subject matter described in this specification can be implemented so as to realize one or more of the following advantages. As an example, implementation of the subject matter improve drilling operations by minimizing stuck drilling pipe incidents due to bad hole cleaning, improving the drilling rate efficiency, minimizing non-productive time due to bad hole cleaning, and minimizing lost resources due to circulation incidents. As another example, implementation of the subject matter improve on existing systems by evaluating cuttings accumulation in annulus, evaluating drilling fluid in real-time, and determining equivalent circulating density without specialized tools. As yet another example, implementation of the subject matter can be applied in any drilling scenarios with any types of drilling fluid system and mud solid control equipment system.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

FIG. 2 illustrates a table of example values of borehole cleaning indicators, according to some implementations of the present disclosure.

FIG. 3 illustrates a table of example recommendations generated based on the values of the borehole cleaning indicators, according to some implementations of the present disclosure.

DETAILED DESCRIPTION

This disclosure describes methods and systems for improving a borehole cleaning efficiency of a borehole drilling operation. In one embodiment, a hole cleaning advisory system (HCAS) calculates indicators that are used to evaluate the borehole cleaning efficiency. To do so, the HCAS receives well data that includes surface rig sensor data and mud rheological properties. The HCAS uses a borehole model and the well data to calculate the borehole cleaning efficiency indicators. The indicators are then used by the HCAS to monitor and evaluate the borehole cleaning efficiency. Monitoring the borehole cleaning efficiency allows the HCAS to help a drilling system (that is performing the drilling operation) to avoid drilling problems. In particular, the HCAS can use the borehole cleaning efficiency to generate recommendations (for example, corrective actions) for improving the drilling operation. In some examples, the HCAS can perform corrective actions based on the recommendations. For instance, the HCAS can control a drilling tool to adjust a drilling parameter that mitigates a detected problem.

For the purposes of this disclosure, the terms "real-time," "real time," "realtime," or similar terms (as understood by one of ordinary skill in the art) mean that an action and a response are temporally proximate such that an individual perceives the action and the response occurring substantially simultaneously. For example, the time difference for a response to display (or for an initiation of a display) of data following the action of an individual to access the data may be less than 1 millisecond (ms), less than 1 second, or less than 5 seconds. While the requested data need not be displayed (or initiated for display) instantaneously, it is displayed (or initiated for display) without any intentional delay, taking into account processing limitations of a described computing system and time required to, for example, gather, accurately measure, analyze, process, store, and/or transmit the data.

Figure 1:
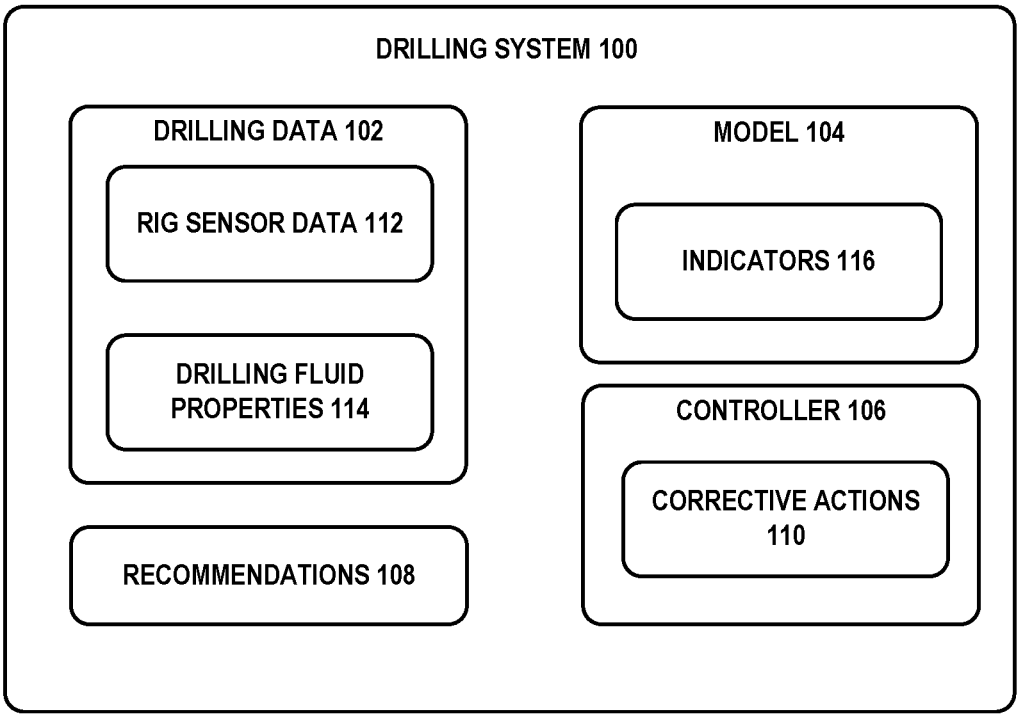
FIG. 1 illustrates a hole cleaning advisory system (HCAS), according to some implementations of the present disclosure.

FIG. 1 illustrates a hole cleaning advisory system (HCAS) 100, according to some implementations. In one embodiment, the HCAS 100 is implemented using a computer system, such as the computer system 500 of FIG. 5. As described in FIG. 5, the computer system 500 can communicate with one or more other computer systems over one or more networks. Note that the HCAS 100 is shown for illustration purposes only, as the HCAS 100 can include additional components or have one or more components removed without departing from the scope of the disclosure. Further, note that the various components of the HCAS 100 can be arranged or connected in any manner.

In some embodiments, the HCAS 100 is a computer-based system that is configured to monitor a drilling operation, provide drilling recommendations to operators, and control a drilling system performing the drilling operation. More specifically, the HCAS 100 is configured to monitor and evaluate borehole cleaning efficiency during the drilling operation. As described in more detail below, monitoring and evaluating the borehole cleaning efficiency enables that HCAS 100 to improve the drilling operation, for example, by proactively avoiding drilling problems or reactively mitigating a detected drilling problem. In one example, the HCAS 100 is configured to generate recommendations that improve the drilling operation. The HCAS 100 can provide drilling teams (or operators) with the recommendations, perhaps, by displaying the recommendation on a user device display or by providing a user notification (for example, an audible, visual, or tactile alert). Additionally or alternatively, the HCAS 100 can take actions based on the borehole cleaning efficiency or the generated recommendations, such as corrective actions that mitigate detected drilling problems, actions that proactively improve the drilling operation, or both.

In some embodiments, the HCAS 100 receives drilling data 102. As shown in FIG. 1, the drilling data 102 includes rig sensor data 112 and drilling fluid (mud) properties 114. The rig sensor data 112 includes data that has been measured by rig sensors, such as surface rig sensors and other devices that are configured for real-time surface and down-wellbore measurements. Examples of the rig sensor data 112 include measurement-while-drilling (MWD) data, logging-while-drilling (LWD) data, drilling rate, rate of penetration (ROP), torque (that is, the movement required to rotate the drilling pipe), spindle speed (that is, the rotation frequency of the spindle of the drilling system, measured in RPM), weight on bit (that is, the amount of downward force exerted on the drilling bit provided by the thick-walled tubular pieces in the drilling assembly), and standard pipe pressure (that is the summation of pressure loss in annulus, pressure loss in drill string, pressure loss in bottom hole assembly (BHA) and pressure loss across the bit), mudflow volume, mud pressure, mud resistivity, gas readings, among other examples. Examples of the mud or drilling fluid properties 114 includes drilling fluid density, viscosity, yield point, gel strength, filtration, and rheology. Other examples of the drilling data 102 include a hole size of the borehole and dimensions of the drill pipe.

In some embodiments, the HCAS 100 uses a model 104 that represents the drilling operation in order to interpret the drilling data 102. The model 104 can be a real-time model of the drilling operation. The HCAS 100 generates the model 104 based on a plurality of predetermined mathematical equations that define parameters for evaluating a borehole cleaning efficiency of the drilling operation. In an example, the model 104 is configured to use the drilling data 102 to calculate one or more of the following hole cleaning indicators 116: (1) a modified carrying capacity index (CCI), (2) a modified cuttings concentration in annulus (CCA), (3) a transport ratio (TR) efficiency (TRE), (4) an effective drilling fluid density (MWeff), (5) an equivalent circulating density (ECD), and (6) transport index (TI). The hole cleaning indicators 116 enable the HCAS 100 to evaluate the borehole cleaning efficiency. Based on the borehole cleaning efficiency, the HCAS 100 can detect potential drilling problems, determine corrective actions to mitigate potential or actual drilling problems, or generate recommendations for improving the drilling operation.

In some embodiments, the model 104 accounts for one or more of the following drilling operation factors: (1) borehole depth and inclination, (2) real-time mud weight, (3) real-time ECD, (4) CCI, (5) CCA, (6) TR, (7) mud lifting capacity, (8) bottom hole assembly (BHA) design, (9) effective viscosity of the drilling fluid, (10) apparent viscosity of the drilling fluid, (11) rheology properties of the drilling fluid, (12) drilling fluid type (for example, oil or water based), (13) hole section type (for example, vertical, deviated, or horizontal), (14) specific gravity of the drilling fluid, (15) low shear yield point (LSYP), (16) temperature effect, (17) connection time, (18) annular borehole area (for example, cased or open hole), (19) cuttings size and density, (20) TI, (21) angle factor, (22) velocity TR, (23) drill bit friction, and (24) circulation and rotation factor.

In some embodiments, the HCAS 100 generates the model 104 in order to provide information indicative of the hole cleaning efficiency optimization. In an example, the HCAS 100 generates the model 104 by applying data mining techniques to the drilling data 102. In some embodiments, machine learning algorithms are applied to the drilling data 102 in order to enhance well drilling and rig performance. The model 104 enables continuous monitoring and evaluation of hole cleaning efficiency while drilling to avoid hole problems and optimize well drilling performance. Additionally, the model 104 enables immediate intervention when the borehole is not being cleaned properly. Further, the model 104 provide information indicative of hole cleaning efficiency and ROP performance optimization.

In some embodiments, the model 104 calculates the hole cleaning indicators 116 using Equations [1]-[44] defined below. More specifically, Equations [1]-[21] are used to calculate fundamental drilling variables, Equations [22]-[25] are used to calculate TRE, Equation [26] is used to calculate effective ECD ($ECD_{eff}$), Equations [27]-[29] are used to calculate $MW_{effc}$, Equations [30]-[33] are used to calculate CCA, and Equations [34]-[44] are used to calculate CCI. MWeffc is the mud weight with the influence of drilling cuttings, rheological properties, and annular pressure effect.

As stated, Equations [1]-[21] are used to calculate fundamental variables, which in turn, can be used to calculate the hole cleaning indicators 116.

$$dc = 0.2\left(\frac{1+ROP}{1+RPM}\right). \quad [1]$$

In Equation [1], dc is a cutting diameter, ROP is rate of penetration of the drilling bit, and RPM is the rate of rotation of the drill bit in rotations per minute. Equation [2] is used to calculate low shear yield point (LSYP) based on the rate of rotation of the drill bit:

$$\text{LSYP}=2(3\ \text{RPM})-6\ \text{RPM}. \quad [2]$$

Equation [3] is used to calculate a slip velocity of the cuttings, $V_{sa}$:

$$V_{sa} = \frac{V_{s5}+V_{sc}}{2}. \quad [3]$$

In Equation [3], $V_{sc}$ is a cuttings velocity (defined in Equation [4]), and $V_{s5}$ is a velocity factor (defined in Equation [6]). Equation [4] is used to calculate the cuttings velocity:

$$V_{sc} = \frac{24.5(1+GPM)}{OH^2-DP^2} - V_{cr}. \quad [4]$$

In Equation [4], $V_{cr}$ is a cuttings rise velocity (defined in Equation [5]), OH is an open hole size of the borehole, DP is a diameter of the borehole, and GPM is a flow rate of the drilling fluid in gallons per minute (GPM). Equation [5] is used to calculate the cuttings rise velocity:

$$V_{cr} = \frac{60}{\left(1-\left(\frac{OD_{pipe}}{\text{Hole size}}\right)^2\right)*\left(0.64+\frac{18.16}{1+ROP}\right)}. \quad [5]$$

In Equation [5], $OD_{pipe}$ is a diameter of the drill pipe, and "Hole size" is a diameter of the borehole (in feet).

Equation [6] is used to calculate a velocity factor ($V_{s5}$):

$$V_{s5} = \left(\frac{V_{s1}+V_{s2}+V_{s3}+V_{s4}}{4}\right)\left(2.117-\frac{0.1648MW_{eff}}{7.481}+0.003681\left(\frac{MW_{eff}}{7.481}\right)^2\right). \quad [6]$$

In Equation [6], $MW_{eff}$ is an effective drilling fluid density in pounds per gallon (lb/gal) and is defined in Equation [20], $V_{s1}$ is a cuttings velocity calculated based on effective viscosity (defined in Equation [7]), $V_{s2}$ is a cuttings velocity calculated based on apparent viscosity (defined in Equation [8]), $V_{s3}$ defined in Equation [9], and $V_{s4}$ is defined in Equation [10]. Equation [7] is used to calculate the cuttings velocity calculated based on effective viscosity:

$$V_{s1} = 0.45\left(\frac{PV}{(MWeff*dc)}\right)\left(\left(\frac{36800}{\left(\frac{PV}{MWeff*dc}\right)^2}dc\left(\frac{Wc}{MWeff}-1\right)+1^{-1}\right)^{0.5}\right). \quad [7]$$

In Equation [7], PV is a plastic viscosity of the drilling fluid in centiPoise (CP) and We is a cuttings density defined in Equation [11]. Equation [8] is used to calculate the cuttings velocity calculated based on apparent viscosity:

$$V_{s2} = 0.45\left(\frac{Meff}{(MWeff*dc)}\right)\left(\frac{(36800)(MWeff)(dc^3)(Wc-MWeff)}{Meff^2}\right)^{0.5}. \quad [8]$$

In Equation [8], Meff an effective viscosity of the drilling fluid defined in Equation [19].

$$V_{s3} = \left(\frac{175(dc)(Wc-MWeff)^{0.667}}{MWeff^{0.333}Mapp^{0.333}}\right). \quad [9]$$

In Equation [9], Mapp is an apparent viscosity of the drilling fluid (defined in Equation [14]).

$$V_{s4} = \left(\frac{175(dc)(Wc-MWeff)^{0.667}}{MWeff^{0.333}Meff^{0.333}}\right). \quad [10]$$

$$Wc = (MWeff)+(1-CCA3)*(MWeff). \quad [11]$$

In Equation [11], CCA3 is defined in Equation [33].

$$Vannc = \left(\frac{Vann + VannInc}{2}\right)\left(1 - CCAm * \frac{Vsa}{\left(\frac{Vann + VannInc}{2}\right)}\right). \quad [12]$$

In Equation [12], Vann is an annular velocity of the drilling fluid (in feet/minute) and is defined in Equation [21], VannInc is defined in Equation [13], and CCAm is defined in Equation [30].

$$VannInc = Vsa*\cos(HA) + Vtr*\sin(HA).$$

In Equation [13], HA is hole angle of inclination.

Equation [14] defines the apparent viscosity of the drilling fluid:

$$Mapp = \frac{2.4Vann}{OH - OD}\left(\frac{2n+1}{3n}\right)^n\left(\frac{200K(OH - OD)}{Vann}\right). \quad [14]$$

In Equation [14], K is a consistency factor (defined in Equation [39]) and n is a flow behavior index of the drilling fluid (defined in Equation [38]).

$$V_{ann_dc} = \frac{24.5(1 + GPM)}{\text{Hole size}^2 - OD_c^2}. \quad [15]$$

In Equation [15], $OD_c$ is a casing diameter.

$$Vc = \left(\left(\frac{1 + ROP}{60}\right)/\left(\frac{\frac{3.14}{4}(\text{Hole size}^2)}{144}\right)\right). \quad [16]$$

$$VannDp = \frac{24.5(1 + GPM)}{\text{Hole size}^2 - OD_{pipe}^2}. \quad [17]$$

$$YPc = \left(\frac{0.5(YP + LSYP)}{0.75\,YP}\right)YP. \quad [18]$$

In Equation [18], YP is a yield point of the drilling fluid in lb/100 $ft^2$.

$$Meff = PV + 300 * YPc\left(\frac{dc}{Vann}\right). \quad [19]$$

$$MWeff = MW * CCA + MW. \quad [20]$$

In Equation [20], MW is the static drilling fluid density (that is, the drilling fluid density without any cuttings). MWeff is the mud weight that accounts for the influence of drilling cuttings.

$$Vann = \frac{24.5(1 + GPM)}{\text{Hole size}^2 - OD_{pipe}^2}. \quad [21]$$

As stated, Equations [22]-[25] are used to calculate TRE.

$$TR = \left(1 - \frac{V_{s5} * Wc}{V_{annc} * ECDeff}\right). \quad [22]$$

In Equation [22], ECDeff is defined in Equation [26].

$$Vtr = 60\left(\left(\frac{Wc - MWeff}{MWeff}\right)(32.2)^3\left(\frac{OH - OD}{12}\right)^3\right)^{\frac{1}{6}}. \quad [23]$$

$$\alpha mc = (\alpha m + CCA). \quad [24]$$

In Equation [24], αm is an open hole and drillstring components annular clearance, and αmc is an open hole and drillstring components annular clearance with cuttings effect.

$$\frac{1}{\alpha m} = \left(\frac{OH^2 - ODc^2}{OH^2}\right) + \left(\frac{\text{Liner_Dl}^2 - OD^2}{OH^2}\right) + \left(\frac{ID_{csg}^2 - OD^2}{OH^2}\right) + \left(\frac{OH^2 - OD^2}{OH^2}\right). \quad [25]$$

In Equation [25], $ID_{csg}^2$ is an inner diameter of the last casing, and $Liner_{Dl}^2$ is an inner diameter of the last liner that was run.

$$ECDeffc = MWeffc + \left(\left(\left(\frac{0.1}{OH - ODDP}\right)\left(YPc + \frac{PV(\alpha mc)(VannC)}{300(OH - OD)}\right)\right)7.481\right)\left(\frac{SPPx}{SPP1}\right)\left(\frac{Depthx}{Depth1}\right). \quad [26]$$

In Equation [26], SPPX is a current (real-time) stand pipe pressure (SPP), SPP1 is a first SPP when ROP is greater than 1, Depth1 is a start measured hole depth, and DepthX is a current measured hole depth.

As stated, Equations [27]-[29] are used to calculate $MW_{effc}$.

$$MWeffc = \left(MW * CCAm * \left(\frac{\alpha m}{CRF}\right) + MW\right) + \left(\frac{SPP1}{SPPx}\right) - \left(\frac{depthx}{depth1}\right) - BF. \quad [27]$$

$$CRF\ (\text{Circulation \& Rotation factor}) = \frac{((1 + GPM) - (1 + RPM))}{((1 + GPM) + (1 + RPM))}. \quad [28]$$

$$BF\ (\text{bit friction}) = \frac{12(1 + \text{torque})}{(1 + WOB)\ \text{Hole size}}. \quad [29]$$

As stated, Equations [30]-[33] are used to calculate CCA.

$$CCAm = (CCA1 + CCA2 + CCA3)/3. \quad [30]$$

$$CCA1 = -\frac{1}{2}\left(\frac{Vann}{Vsa} - 1\right) + \left(\frac{1}{4}\left(\frac{Vann}{Vsa} - 1\right)^2 + \frac{Vann}{Vsa} \times \frac{Vann}{Vsa}\frac{Vc}{\frac{1 + GPM}{7.48}}\right)^{0.5}. \quad [31]$$

$$CCA2 = \frac{1}{1 + \left(1 - \frac{OO}{OH}\right)\left(\frac{\text{Vann_dp} - Vsa}{30}\right)\left(\frac{1800}{1 + ROP} + \frac{Vsa}{\text{Vann_dc} - Vsa}Tc\right)}. \quad [32]$$

$$CCA3 = \frac{(1 + ROP)(OH^2)}{1471(GPM + 1)(TR)}. \quad [33]$$

As stated, Equations [34] — [44] are used to calculate CCI.

$$CCI1 = \left(\frac{MWeffc * K * V_{annc}}{2992400}\right). \quad [34]$$

$$CCI2 = \left(\frac{KTI}{598\ Aa\ RF}\right). \quad [35]$$

$$CCI3 = \frac{(MWeffc)(K)Af}{37315Aa}. \quad [36]$$

$$CCIm = (CCI1 + CCI2 + CCI3)/3. \quad [37]$$

$$n = 3.32 * \log\left(\frac{2PV + YPc}{PV + YPc}\right). \quad [38]$$

$$K = 511^{1-n}(PV - YPc). \quad [39]$$

$$SG = \frac{MWeffc}{62.4}. \quad [40]$$

$$RF = 0.5\left(\frac{pv}{ypc} + \frac{ypc}{pv}\right)\left(1 - \frac{T2}{T1} * CCA\right). \quad [41]$$

In Equation [41], T2 & T1 Temperatures of hole. RF is a rheology factor.

$$Aa = \frac{3.14}{4 * 144}(OH^2 - OD^2). \quad [42]$$

Equation [42] defines an annulus area, Aa.

$$AF=(0.0001*(HA)^2-0.0255*HA+2.0784)(1-CCA). \quad [43]$$

$$TI=AF*RF*SG. \quad [44]$$

In some embodiments, the HCAS 100 monitors the one or more indicators 116 by assessing the values of the one or more indicators 116. In an example, each indicator 116 is associated with an optimized range of values, an acceptable range of values, and an unacceptable range of values. In this example, the HCAS 100 can determine that the status of a particular indicator based on whether the current value of the indicator is within the optimized range, the acceptable range, or the unacceptable range of values.

FIG. 2 illustrates a table 200 of example values for a borehole cleaning indicators, according to some implementations. In particular, the table 200 includes example ranges for the transport ratio, cuttings concentration in the annulus, carrying capacity index, and transport index. As shown in table 200, the transport ratio is optimized if its current value is greater than 0.65, is acceptable if the current value is between 0.5 and 0.65, and unacceptable if the current value is less than or equal to 0.5. The cuttings concentration in the annulus is optimized if its current value is less than or equal to 0.05 and greater than 0.03, acceptable if its current value is less than or equal to 0.03 and greater than or equal to 0, and unacceptable if its current value is greater than 0.05. The carrying capacity index is optimized if its current value is greater than 3, acceptable if its current value is less than or equal to 3 and greater 3, and unacceptable if its current value is less than or equal to 1. The transport index is optimized if its current value is greater than 2.5, acceptable if its current value is less than 2.5 and greater than or equal to 1.5, and unacceptable if its current value is less than 1.5.

In some embodiments, the HCAS 100 uses the model 104 to continuously or periodically monitor and evaluate borehole cleaning efficiency to avoid hole problems and improve well drilling performance. For example, the HCAS 100 is configured to intervene by performing a corrective action when a wellbore is not being cleaned properly. Further, the HCAS 100 can use the borehole cleaning efficiency to determine actions that improve the well drilling performance, such as determining a rate of penetration (ROP) that improves the drilling operation (for example, by improving the efficiency of the drilling operation). Furthermore, the HCAS 100 can send instructions to other drilling tools or systems to perform actions that avoid hole problems or improve well drilling performance. In some examples, the HCAS 100 generates recommendations based on a predetermined set of rules or guidelines. Example guidelines include: (i) increase GPM only if less than recommended, (ii) increase ROP only when possible, and (iii) reduce ROP only where the operation is drilling.

FIG. 3 illustrates a table 300 of example recommendations generated based on the values of the borehole cleaning indicators, according to some implementations. In this example, the table 300 includes recommendations based on the values of CCA, CCI, and TR. In table 300, the value of a particular indicator being within an optimized range is represented by "Green," within an acceptable range is represented by "Yellow," and within an unacceptable range is represented by "Red." As shown in table 300, example recommendations include controlling the rate of penetration (ROP), controlling the rheological properties of the drilling fluid, and controlling the rate of flow of the drilling fluid (GPM).

In some embodiments, the HCAS 100 can display the recommendations on a display. As an example, the HCAS 100 can display, for example, to drilling teams, down hole readings from surface reading usage. The HCAS 100 can also provide drilling teams with continuous monitoring, evaluation, optimization, and recommendations regarding hole cleaning performance and efficiency. As such, the HCAS 100 helps mitigate hole problems and improves drilling rate, which results in safer and more economical wells.

Figure 6:
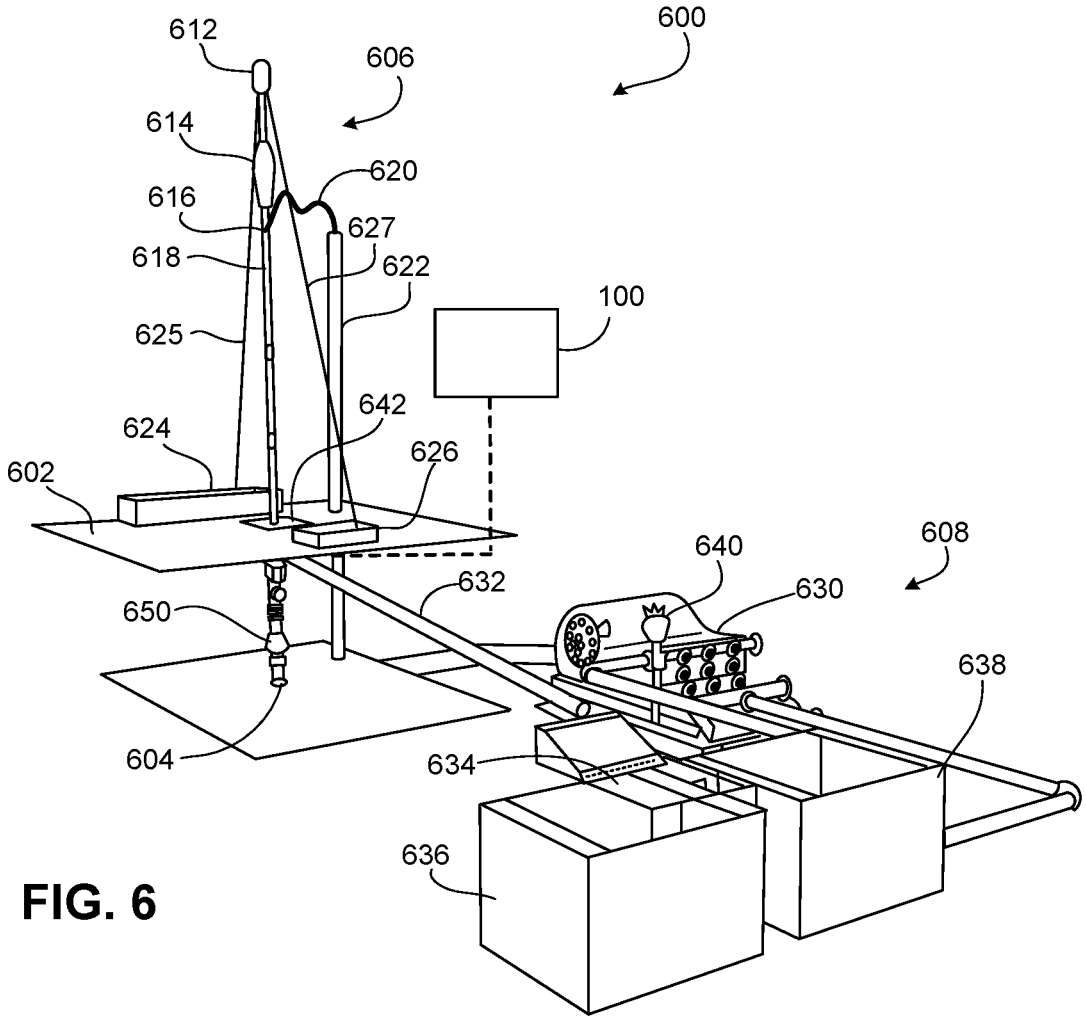
FIG. 6 is a partial schematic perspective view of an example rig system for drilling and producing a well, according to some implementations of the present disclosure.

In some embodiments, the HCAS 100 can determine to make one or more adjustments to the drilling operation (for example, by controlling a component or system of the drilling system of FIG. 6), perhaps to meet changing downhole conditions. As an example, the HCAS 100 can send instructions to a mud system to circulate cuttings to the surface and ensure smooth drilling rate based on the desired mud efficiency. The adjustments may be to surface properties, mechanical parameters (for example, ROP, flow rate, pipe-rotation speed, and tripping speed), or both. In response to making the determination to make one or more adjustments, the HCAS 100 adjusts the operating parameters of one or more components of the HCAS 100 to adjust the surface properties, the mechanical parameters, or both.

In one example, the HCAS 100 determines a maximum rate of penetration for a drill bit of drilling system (for example, the drilling system of FIG. 6). More specifically, the effective drilling fluid density, a pore pressure limit of the formation, and a fracture pressure limit of the formation are used to calculate the stability of the formation. Then, based on the calculated stability, the maximum rate of penetration is calculated. Additionally, the HCAS 100 can control the rate of penetration, perhaps to be less than the calculated maximum rate. Controlling the rate of penetration allows the HCAS 100 to: (i) avoid fracturing the formation while drilling, (ii) ensure smooth drilling with generated drilling cuttings, and (iii) avoid or mitigate stuck pipe incidents. In an example, the rate of penetration may be calculated using the effective drilling fluid density using Equation [45]:

$$ROP = \frac{810 * (MW_{eff} - MW) * GPM}{(MW * OH^2)}. \quad [45]$$

Figure 4:
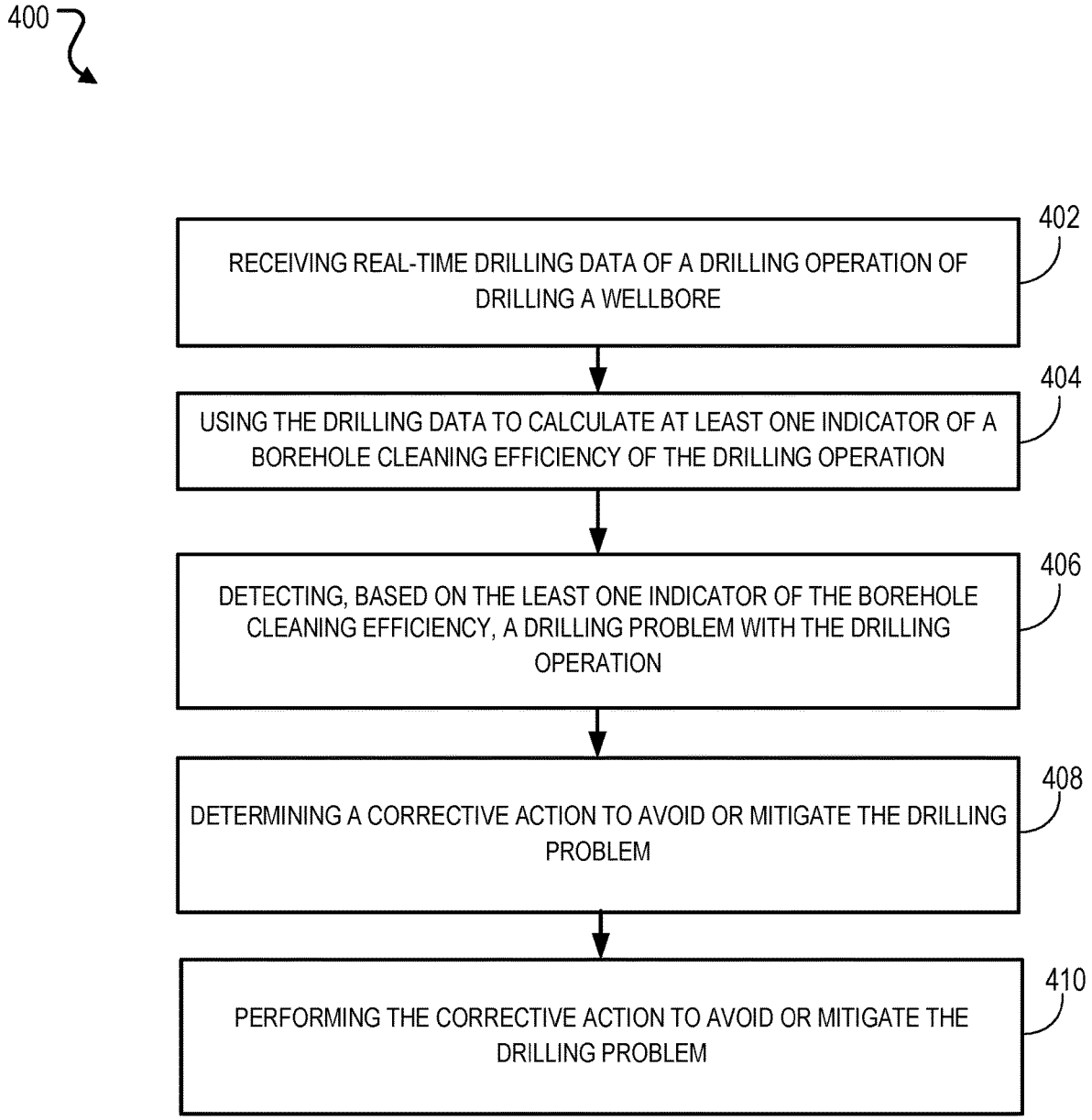
FIG. 4 illustrates a flowchart of an example method, according to some implementations of the present disclosure.

FIG. 4 is a flowchart of an example method 400, according to some implementations. The method 400 is for improving a borehole cleaning efficiency of a borehole drilling operation by calculating and monitoring real-time indicators of borehole cleaning efficiency. For clarity of presentation, the description that follows generally describes method 400 in the context of the other figures in this description. However, it will be understood that method 400 can be performed, for example, by any suitable system, environment, software, hardware, or a combination of systems, environments, software, and hardware, as appropriate. In some implementations, various steps of method 300 can be run in parallel, in combination, in loops, or in any order.

At step 402, method 400 involves receiving real-time drilling data of a drilling operation of drilling a wellbore.

At step 404, method 400 involves using the drilling data to calculate at least one indicator of a borehole cleaning efficiency of the drilling operation.

At step 406, method 400 involves detecting, based on the least one indicator of the borehole cleaning efficiency, a drilling problem with the drilling operation.

At step 408, method 400 involves determining a corrective action to avoid or mitigate the drilling problem; and At step 410, method 400 involves performing the corrective action to avoid or mitigate the drilling problem.

Figure 5:
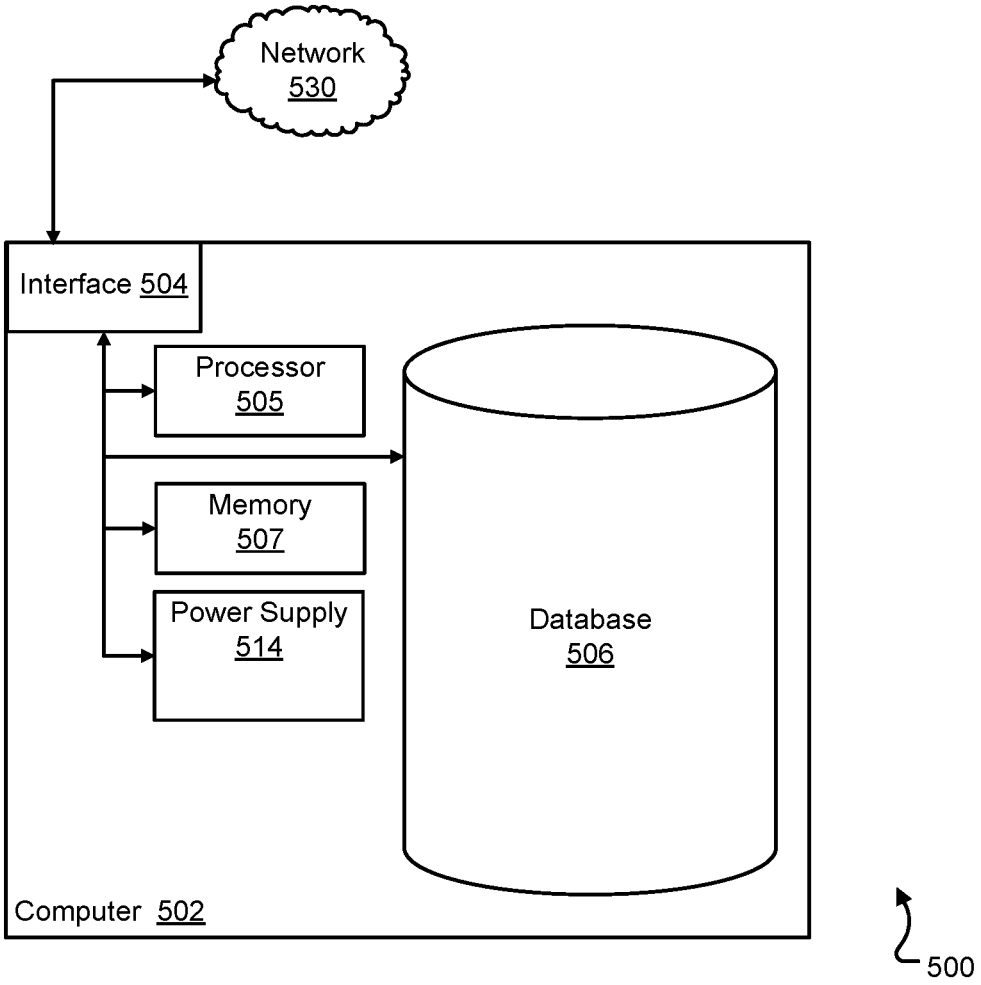
FIG. 5 illustrates an example computing environment for implementing the techniques described herein, according to some implementations of the present disclosure.

FIG. 5 is a block diagram of an example computer system 500 that can be used to provide computational functionalities associated with described algorithms, methods, functions, processes, flows, and procedures described in the present disclosure, according to some implementations of the present disclosure. In some implementations, the HCAS 100 can be the computer system 500, include the computer system 500, or include part of the computer system 500. In some implementations, the HCAS 100 can communicate with the computer system 500.

The illustrated computer 502 is intended to encompass any computing device such as a server, a desktop computer, embedded computer, a laptop/notebook computer, a wireless data port, a smart phone, a personal data assistant (PDA), a tablet computing device, or one or more processors within these devices, including physical instances, virtual instances, or both. The computer 502 can include input devices such as keypads, keyboards, and touch screens that can accept user information. Also, the computer 502 can include output devices that can convey information associated with the operation of the computer 502. The information can include digital data, visual data, audio information, or a combination of information. The information can be presented in a graphical user interface (UI) (or GUI). In some implementations, the inputs and outputs include display ports (such as DVI-I+2x display ports), USB 3.0, GbE ports, isolated DI/O, SATA-III (6.0 Gb/s) ports, mPCIe slots, a combination of these, or other ports. In instances of an edge gateway, the computer 502 can include a Smart Embedded Management Agent (SEMA), such as a built-in ADLINK SEMA 2.2, and a video sync technology, such as Quick Sync Video technology supported by ADLINK MSDK+. In some examples, the computer 502 can include the MXE-5400 Series processor-based fanless embedded computer by ADLINK, though the computer 502 can take other forms or include other components.

The computer 502 can serve in a role as a client, a network component, a server, a database, a persistency, or components of a computer system for performing the subject matter described in the present disclosure. The illustrated computer 502 is communicably coupled with a network 530. In some implementations, one or more components of the computer 502 can be configured to operate within different environments, including cloud-computing-based environments, local environments, global environments, and combinations of environments.

At a high level, the computer 502 is an electronic computing device operable to receive, transmit, process, store, and manage data and information associated with the described subject matter. According to some implementations, the computer 502 can also include, or be communicably coupled with, an application server, an email server, a web server, a caching server, a streaming data server, or a combination of servers.

The computer 502 can receive requests over network 530 from a client application (for example, executing on another computer 502). The computer 502 can respond to the received requests by processing the received requests using software applications. Requests can also be sent to the computer 502 from internal users (for example, from a command console), external (or third) parties, automated applications, entities, individuals, systems, and computers.

Each of the components of the computer 502 can communicate using a system bus. In some implementations, any or all of the components of the computer 502, including hardware or software components, can interface with each other or the interface 504 (or a combination of both), over the system bus. Interfaces can use an application programming interface (API), a service layer, or a combination of the API and service layer. The API can include specifications for routines, data structures, and object classes. The API can be either computer-language independent or dependent. The API can refer to a complete interface, a single function, or a set of APIs.

The service layer can provide software services to the computer 502 and other components (whether illustrated or not) that are communicably coupled to the computer 502. The functionality of the computer 502 can be accessible for all service consumers using this service layer. Software services, such as those provided by the service layer, can provide reusable, defined functionalities through a defined interface. For example, the interface can be software written in JAVA, C++, or a language providing data in extensible markup language (XML) format. While illustrated as an integrated component of the computer 502, in alternative implementations, the API or the service layer can be standalone components in relation to other components of the computer 502 and other components communicably coupled to the computer 502. Moreover, any or all parts of the API or the service layer can be implemented as child or submodules of another software module, enterprise application, or hardware module without departing from the scope of the present disclosure.

The computer 502 can include an interface 504. Although illustrated as a single interface 504 in FIG. 5, two or more interfaces 504 can be used according to particular needs, desires, or particular implementations of the computer 502 and the described functionality. The interface 504 can be used by the computer 502 for communicating with other systems that are connected to the network 530 (whether illustrated or not) in a distributed environment. Generally, the interface 504 can include, or be implemented using, logic encoded in software or hardware (or a combination of software and hardware) operable to communicate with the network 530. More specifically, the interface 504 can include software supporting one or more communication protocols associated with communications. As such, the network 530 or the interface's hardware can be operable to communicate physical signals within and outside of the illustrated computer 502.

The computer 502 includes a processor 505. Although illustrated as a single processor 505 in FIG. 5, two or more processors 505 can be used according to particular needs, desires, or particular implementations of the computer 502 and the described functionality. Generally, the processor 505 can execute instructions and can manipulate data to perform the operations of the computer 502, including operations using algorithms, methods, functions, processes, flows, and procedures as described in the present disclosure.

The computer 502 can also include a database 506 that can hold data for the computer 502 and other components connected to the network 530 (whether illustrated or not). For example, database 506 can be an in-memory, conventional, or a database storing data consistent with the present disclosure. In some implementations, database 506 can be a combination of two or more different database types (for example, hybrid in-memory and conventional databases) according to particular needs, desires, or particular implementations of the computer 502 and the described functionality. Although illustrated as a single database 506 in FIG. 5, two or more databases (of the same, different, or combination of types) can be used according to particular needs, desires, or particular implementations of the computer 502 and the described functionality. While database 506 is illustrated as an internal component of the computer 502, in alternative implementations, database 506 can be external to the computer 502.

The computer 502 also includes a memory 507 that can hold data for the computer 502 or a combination of components connected to the network 530 (whether illustrated or not). Memory 507 can store any data consistent with the present disclosure. In some implementations, memory 507 can be a combination of two or more different types of memory (for example, a combination of semiconductor and magnetic storage) according to particular needs, desires, or particular implementations of the computer 502 and the described functionality. Although illustrated as a single memory 507 in FIG. 5, two or more memories 507 (of the same, different, or combination of types) can be used according to particular needs, desires, or particular implementations of the computer 502 and the described functionality. While memory 507 is illustrated as an internal component of the computer 502, in alternative implementations, memory 507 can be external to the computer 502.

An application can be an algorithmic software engine providing functionality according to particular needs, desires, or particular implementations of the computer 502 and the described functionality. For example, an application can serve as one or more components, modules, or applications. Multiple applications can be implemented on the computer 502. Each application can be internal or external to the computer 502.

The computer 502 can also include a power supply 514. The power supply 514 can include a rechargeable or non-rechargeable battery that can be configured to be either user- or non-user-replaceable. In some implementations, the power supply 514 can include power-conversion and management circuits, including recharging, standby, and power management functionalities. In some implementations, the power-supply 514 can include a power plug to allow the computer 502 to be plugged into a wall socket or a power source to, for example, power the computer 502 or recharge a rechargeable battery.

There can be any number of computers 502 associated with, or external to, a computer system including computer 502, with each computer 502 communicating over network 530. Further, the terms "client," "user," and other appropriate terminology can be used interchangeably, as appropriate, without departing from the scope of the present disclosure. Moreover, the present disclosure contemplates that many users can use one computer 502 and one user can use multiple computers 502.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification includes many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

FIG. 6 is a partial schematic perspective view of an example rig system 600 for drilling and producing a well. As shown in FIG. 6, the rig system 600 can communicate with the HCAS 100. The well can extend from the surface through the Earth to one or more subterranean zones of interest. The example rig system 600 includes a drill floor 602 positioned above the surface, a wellhead 604, a drill string assembly 606 supported by the rig structure, and a fluid circulation system 608 to filter used drilling fluid from the wellbore and provide clean drilling fluid to the drill string assembly 606. For example, the example rig system 600 of FIG. 6 is shown as a drill rig capable of performing a drilling operation with the rig system 600 supporting the drill string assembly 606 over a wellbore. The wellhead 604 can be used to support casing or other well components or equipment into the wellbore of the well.

The derrick or mast is a support framework mounted on the drill floor 602 and positioned over the wellbore to support the components of the drill string assembly 606 during drilling operations. A crown block 612 forms a longitudinally-fixed top of the derrick, and connects to a travelling block 614 with a drilling line including a set of wire ropes or cables. The crown block 612 and the travelling block 614 support the drill string assembly 606 via a swivel 616, a kelly 618, or a top drive system (not shown). Longitudinal movement of the travelling block 614 relative to the crown block 612 of the drill string assembly 606 acts to move the drill string assembly 606 longitudinally upward and downward. The swivel 616, connected to and hung by the travelling block 614 and a rotary hook, allows free rotation of the drill string assembly 606 and provides a connection to a kelly hose 620, which is a hose that flows drilling fluid from a drilling fluid supply of the circulation system 608 to the drill string assembly 606. A standpipe 622 mounted on the drill floor 602 guides at least a portion of the kelly hose 620 to a location proximate to the drill string assembly 606. The kelly 618 is a hexagonal device suspended from the swivel 616 and connected to a longitudinal top of the drill string assembly 606, and the kelly 618 turns with the drill string assembly 606 as the rotary table 642 of the drill string assembly turns.

In the example rig system 600 of FIG. 6, the drill string assembly 606 is made up of drill pipes with a drill bit (not shown) at a longitudinally bottom end of the drill string. The drill pipe can include hollow steel piping, and the drill bit can include cutting tools, such as blades, dics, rollers, cutters, or a combination of these, to cut into the formation and form the wellbore. The drill bit rotates and penetrates through rock formations below the surface under the combined effect of axial load and rotation of the drill string assembly 606. In some implementations, the kelly 618 and swivel 616 can be replaced by a top drive that allows the drill string assembly 606 to spin and drill. The wellhead assembly 604 can also include a drawworks 624 and a deadline anchor 626, where the drawworks 624 includes a winch that acts as a hoisting system to reel the drilling line in and out to raise and lower the drill string assembly 606 by a fast line 625. The deadline anchor 626 fixes the drilling line opposite the drawworks 624 by a deadline 627, and can measure the suspended load (or hook load) on the rotary hook. The weight on bit (WOB) can be measured when the drill bit is at the bottom the wellbore. The wellhead assembly 604 also includes a blowout preventer 650 positioned at the surface of the well and below (but often connected to) the drill floor 602. The blowout preventer 650 acts to prevent well blowouts caused by formation fluid entering the wellbore, displacing drilling fluid, and flowing to the surface at a pressure greater than atmospheric pressure. The blowout preventer 650 can close around (and in some instances, through) the drill string assembly 606 and seal off the space between the drill string and the wellbore wall. The blowout preventer 650 is described in more detail later.

During a drilling operation of the well, the circulation system 608 circulates drilling fluid from the wellbore to the drill string assembly 606, filters used drilling fluid from the wellbore, and provides clean drilling fluid to the drill string assembly 606. The example circulation system 608 includes a fluid pump 630 that fluidly connects to and provides drilling fluid to drill string assembly 606 via the kelly hose 620 and the standpipe 622. The circulation system 608 also includes a flow-out line 632, a shale shaker 634, a settling pit 636, and a suction pit 638. In a drilling operation, the circulation system 608 pumps drilling fluid from the surface, through the drill string assembly 606, out the drill bit and back up the annulus of the wellbore, where the annulus is the space between the drill pipe and the formation or casing. The density of the drilling fluid is intended to be greater than the formation pressures to prevent formation fluids from entering the annulus and flowing to the surface and less than the mechanical strength of the formation, as a greater density may fracture the formation, thereby creating a path for the drilling fluids to go into the formation. Apart from well control, drilling fluids can also cool the drill bit and lift rock cuttings from the drilled formation up the annulus and to the surface to be filtered out and treated before it is pumped down the drill string assembly 606 again. The drilling fluid returns in the annulus with rock cuttings and flows out to the flow-out line 632, which connects to and provides the fluid to the shale shaker 634. The flow line is an inclined pipe that directs the drilling fluid from the annulus to the shale shaker 634. The shale shaker 634 includes a mesh-like surface to separate the coarse rock cuttings from the drilling fluid, and finer rock cuttings and drilling fluid then go through the settling pit 636 to the suction pit 636. The circulation system 608 includes a mud hopper 640 into which materials (for example, to provide dispersion, rapid hydration, and uniform mixing) can be introduced to the circulation system 608. The fluid pump 630 cycles the drilling fluid up the standpipe 622 through the swivel 616 and back into the drill string assembly 606 to go back into the well.

The example wellhead assembly 604 can take a variety of forms and include a number of different components. For example, the wellhead assembly 604 can include additional or different components than the example shown in FIG. 6. Similarly, the circulation system 608 can include additional or different components than the example shown in FIG. 6.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of the present disclosure have been described. Nevertheless, it will be understood that various modifications may be made without departing from the spirit and scope of the present disclosure. Accordingly, other embodiments are within the scope of the following claims.

Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

We claim:

1. A computer-implemented method, comprising:

receiving real-time drilling data of a drilling operation of drilling a wellbore by a drilling system;

using the real-time drilling data to calculate a modified carrying capacity index (CCI), a modified cuttings concentration in annulus (CCA), and a transport ratio (TR) of the drilling operation;

generating a respective color-coded indicator of each of the CCI, CCA, and TR by comparing each of the CCI, CCA, and TR to a respective predetermined range;

detecting, based on the respective color-coded indicators, a drilling problem with the drilling operation;

determining, based on a table of corrective actions, a corrective action to mitigate the drilling problem, wherein the table of corrective actions maps different values of the respective color-coded indicators to corrective actions, wherein the corrective action comprises controlling a rate of penetration of a drilling tool of the drilling system to be less than a maximum penetration rate;

determining the maximum rate of penetration based on an effective drilling fluid density, a pore pressure limit of a formation, and a fracture pressure limit of the formation;

determining, based on the real-time drilling data, the maximum rate of penetration for the drilling tool; and controlling the drilling tool such that the rate of penetration of the drilling tool is less than or equal to the maximum rate of penetration, thereby mitigating the drilling problem.

2. The computer-implemented method of claim 1, further comprising:

controlling the drilling system to adjust one or more additional drilling parameters that further mitigate the drilling problem.

3. The computer-implemented method of claim 2, wherein the one or more additional drilling parameters comprise: a hole size of the wellbore and a flow rate in gallons per minute (GPM) of drilling fluid.

4. The computer-implemented method of claim 1, wherein determining the rate of penetration for the drilling tool is further based on the pore pressure limit and the fracture pressure limit.

5. The computer-implemented method of claim 1, further comprising:

displaying, via a graphical user interface (GUI), drilling instructions to perform the corrective action.

6. One or more non-transitory computer-readable storage media coupled to one or more processors and having instructions stored thereon which, when executed by the one or more processors, cause the one or more processors to perform operations comprising:

receiving real-time drilling data of a drilling operation of drilling a wellbore by a drilling system;

using the real-time drilling data to calculate a modified carrying capacity index (CCI), a modified cuttings concentration in annulus (CCA), and a transport ratio (TR) of the drilling operation;

generating a respective color-coded indicator of each of the CCI, CCA, and TR by comparing each of the CCI, CCA, and TR to a respective predetermined range;

detecting, based on the respective color-coded indicators, a drilling problem with the drilling operation;

determining, based on a table of corrective actions, a corrective action to mitigate the drilling problem, wherein the table of corrective actions maps different values of the respective color-coded indicators to corrective actions, wherein the corrective action comprises controlling a rate of penetration of a drilling tool of the drilling system to be less than a maximum penetration rate;

determining the maximum rate of penetration based on an effective drilling fluid density, a pore pressure limit of a formation, and a fracture pressure limit of the formation;

determining, based on the real-time drilling data, the maximum rate of penetration for the drilling tool; and controlling the drilling tool such that the rate of penetration of the drilling tool is less than or equal to the maximum rate of penetration, thereby mitigating the drilling problem.

7. The non-transitory computer-readable storage media of claim 6, the operations further comprising:

controlling the drilling system to adjust one or more additional drilling parameters that further mitigate the drilling problem.

8. The non-transitory computer-readable storage media of claim 7, wherein the one or more additional drilling parameters comprise: a hole size of the wellbore and a flow rate in gallons per minute (GPM) of drilling fluid.

9. The non-transitory computer-readable storage media of claim 6, wherein determining the rate of penetration for the drilling tool is further based on the pore pressure limit and the fracture pressure limit.

10. The non-transitory computer-readable storage media of claim 6, the operations further comprising :

displaying, via a graphical user interface (GUI), drilling instructions to perform the corrective action.

11. A system, comprising:

one or more processors; and a computer-readable storage device coupled to the one or more processors and having instructions stored thereon which, when executed by the one or more processors, cause the one or more processors to perform operations comprising:

receiving real-time drilling data of a drilling operation of drilling a wellbore by a drilling system;

using the real-time drilling data to calculate a modified carrying capacity index (CCI), a modified cuttings concentration in annulus (CCA), and a transport ratio (TR) of the drilling operation;

generating a respective color-coded indicator of each of the CCI, CCA, and TR by comparing each of the CCI, CCA, and TR to a respective predetermined range;

detecting, based on the respective color-coded indicators, a drilling problem with the drilling operation;

determining, based on a table of corrective actions, a corrective action to mitigate the drilling problem, wherein the table of corrective actions maps different values of the respective color-coded indicators to corrective actions, wherein the corrective action comprises controlling a rate of penetration of a drilling tool of the drilling system to be less than a maximum penetration rate;

determining the maximum rate of penetration based on an effective drilling fluid density, a pore pressure limit of a formation, and a fracture pressure limit of the formation;

determining, based on the real-time drilling data, the maximum rate of penetration for the drilling tool; and controlling the drilling tool such that the rate of penetration of the drilling tool is less than or equal to the maximum rate of penetration, thereby mitigating the drilling problem.

12. The system of claim 11, the operations further comprising:

controlling the drilling system to adjust one or more additional drilling parameters that further mitigate the drilling problem.

13. The system of claim 12, wherein the one or more additional drilling parameters comprise: a hole size of the wellbore and a flow rate in gallons per minute (GPM) of drilling fluid.

14. The system of claim 11, wherein determining the rate of penetration for the drilling tool is further based on the pore pressure limit and the fracture pressure limit.

15. The system of claim 11, the operations further comprising :

displaying, via a graphical user interface (GUI), drilling instructions to perform the corrective action.

* * * * *